US008449053B2

(12) United States Patent
Ito et al.

(10) Patent No.: US 8,449,053 B2
(45) Date of Patent: May 28, 2013

(54) LIQUID EJECTING APPARATUS AND LIQUID CHARGING METHOD

(75) Inventors: Hiroyuki Ito, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 360 days.

(21) Appl. No.: 12/890,851

(22) Filed: Sep. 27, 2010

(65) Prior Publication Data

US 2011/0074873 A1 Mar. 31, 2011

(30) Foreign Application Priority Data

Sep. 28, 2009 (JP) ..... 2009-222103
Jul. 9, 2010 (JP) ..... 2010-156586

(51) Int. Cl.
*B41J 29/38* (2006.01)

(52) U.S. Cl.
USPC ..... 347/6; 347/30

(58) Field of Classification Search
None
See application file for complete search history.

(56) References Cited

U.S. PATENT DOCUMENTS

| | | | | |
|---|---|---|---|---|
| 7,547,097 | B2 | 6/2009 | Tsukada et al. | |
| 2007/0188538 | A1 * | 8/2007 | Izuo | 347/19 |
| 2008/0122902 | A1 | 5/2008 | Tanaka et al. | |
| 2009/0179974 | A1 * | 7/2009 | Kimura | 347/85 |

FOREIGN PATENT DOCUMENTS

| | | |
|---|---|---|
| JP | 2004-299292 | 10/2004 |
| JP | 2006-137181 | 6/2006 |
| JP | 2007-196442 | 8/2007 |
| JP | 2008-126408 | 6/2008 |
| JP | 2008-132712 | 6/2008 |

* cited by examiner

*Primary Examiner* — Matthew Luu
*Assistant Examiner* — Justin Seo
(74) *Attorney, Agent, or Firm* — Workman Nydegger

(57) ABSTRACT

A liquid ejecting apparatus includes a liquid ejecting head with one nozzle group for ejecting one type liquid and another nozzle group for ejecting two types of liquid, thereby ejecting multiple types of liquid from the nozzle groups. A cap forms a sealing space that is suctioned by a suction pump. Flow-passages supply the liquid from a liquid container toward the liquid ejecting head. Flow-passage pumps in the downstream side of the liquid container in the flow-passages suction the liquid from the liquid container and discharge the liquid toward the downstream side. A choke valve has a valve chamber at the downstream side of the flow-passage pump to allow the liquid to flow therein. A flexible member changes a volume of the valve chamber by flexing. A discharge hole in an inner portion of the valve chamber is opened or closed by the flexing of the flexible member.

8 Claims, 8 Drawing Sheets

51
C
M
Y
MK
PK
P
CV
RV
S
54, 547
56
57
58
33
33a
61
62
63
64

LIQUID EJECTING APPARATUS AND LIQUID CHARGING METHOD

BACKGROUND

1. Technical Field

The invention relates to a liquid ejecting apparatus and a liquid providing method.

2. Related Art

JP-A-2004-299292 discloses an initial providing manipulation for providing plural types of liquid, which are in a vapor state at the time of staring an initial use of an apparatus, into a plurality of liquid supply passages. A controller disclosed in JP-A-2004-299292 first allows some of a plurality of valve units to be in an opened state and allows all the remaining valve units to be in a closed state. Next, only the liquid supply passages corresponding to the valve units in the opened state are allowed to be precedingly charged. If the preceding charge is completed, the valve units in the opened state is allowed to be closed, and at least a portion of the remaining valve units in the closed state is allowed to be opened to charge the corresponding liquid supply passages.

In addition, JP-A-2008-126408 discloses a configuration where cap portions (first cap portion and second cap portion) are allowed to contact with a nozzle formation portion and where the cap portions are divided into a plurality of partitioned chambers so as to suction each partitioned chamber with a simple, easy configuration.

In addition, JP-A-2008-132712 discloses a configuration where a switching mechanism for changing a type of liquid is included.

However, in the configuration disclosed in JP-A-2008-132712, in the case of performing the initial providing of two types of ink in the liquid ejecting apparatus having the switching mechanism, an ink irrelevant to the two types of ink may also be unnecessarily discarded.

Therefore, a method of reducing the unnecessarily discharging ink amount by adapting the configuration of JP-A-2004-299292 or JP-A-2008-126408 to the configuration of the JP-A-2008-132712 is considered. However, in the aforementioned configuration disclosed in JP-A-2004-299292, since the valve unit is provided to each column so as to reduce the consumed ink amount at the time of initial providing, the cost is increased by the amount corresponding to this configuration. In addition, the control for driving each valve unit is complicated.

In addition, in the configuration disclosed in JP-A-2008-126408, a first cap portion and a second cap portion are provided, and a valve is provided to a tube communicating with the first cap portion, so that the cost is increased by the amount corresponding to this configuration and so that the control is also complicated.

Herein, the configuration where the initial providing of the ink may be performed in the cap having one suction chamber of which the inner portion is not partitioned is advantageous in terms of cost due to the simple configuration of the cap. However, even in the case of using such a cap, it is preferable to prevent the ink from being uselessly wasted.

SUMMARY

An advantage of some aspects of the invention is to provide a liquid ejecting apparatus having a switching mechanism and a simple and easy configuration of a cap and being capable of reducing a uselessly wasted liquid amount and a liquid providing method.

According to an aspect of the invention, there is provided a liquid ejecting apparatus including: a liquid ejecting head which is configured to have a nozzle group of ejecting one type liquid and a nozzle group of ejecting two types of liquid to be capable of ejecting plural types of the liquid from a plurality of the nozzle groups; a cap which is configured to contact with a nozzle formation plane, where the nozzle groups of the liquid ejecting head are exposed, to form one sealing space; a suction pump which is configured to suction the sealing space; a plurality of flow-passages which are configured to supply the plurality types of the liquid from a liquid container toward the liquid ejecting head; flow-passage pumps which are located at the downstream side from the liquid container in the plurality of flow-passages to be capable of suctioning the liquid from the liquid container and discharging the liquid toward the downstream side; a choke valve which is configured to have a valve chamber which is located at the downstream side from the flow-passage pump in the plurality of the flow-passages to allow the liquid to be flown therein, a flexible member which is configured to change a volume of the valve chamber by flexing, and a discharge hole which exists in an inner portion of the valve chamber to be capable of being opened or closed by the flexing of the flexible member, wherein in the case where a predetermined negative pressure or more is exerted to the valve chamber, the flexible member is allowed to close the discharge hole, so that the downstream side thereof is allowed to be in a negative pressure state; a switching mechanism which is located at the downstream side from the choke valve located to two flow-passages among the plurality of the flow-passages and which is connected to one flow-passage for supplying the liquid of the two flow-passages to the nozzle group of ejecting the two types of the liquid to allow supply of some liquid and to block supply of non-selected liquid; a controller which is configured to control operations of the liquid ejecting head, the suction pump, the switching mechanism, and the flow-passage pump, wherein the controller allows all the flow-passage pumps to be operated so as for a predetermined amount of the liquid to be in a dischargeable state, allows the cap to contact with the nozzle formation plane so as for the suction pump to be operated, and allows the switching mechanism to be operated so as for the predetermined amount at the time of providing the liquid into all the flow-passages to be equal to or more than a liquid amount required for providing the liquid into all the flow-passages and to be equal to or less than twice the liquid amount required for providing the ink to all the flow-passages.

According to the configuration, after the operation of the flow-passage pump, the controller allows the cap to contact with the nozzle formation plane so as for the suction pump to be operated. Accordingly, it is possible to provide the liquid to the flow-passage except for the flow-passage which is not selected by the switching mechanism. In addition, since the switching mechanism is driven, it is possible to provide the ink to the flow-passage which is not initially selected by the switching mechanism. At this time, since the dischargeable liquid amount by the operation of the flow-passage pump is controlled to be equal or more than the liquid amount required for providing the ink to all the flow-passages and to be less than twice the liquid amount required for providing the ink to all the flow-passages, it is possible to reduce the liquid amount which is uselessly discharged. In addition, since the initial providing of the liquid is performed by using the cap which forms one sealing space, the configuration of the cap is simplified, so that it is possible to reduce the cost. In addition, it is possible to suppress the configuration from being complicated, so that it is possible to reduce the cost.

In the liquid ejecting apparatus according to the invention, the controller allows all the flow-passage pumps to be operated so as for a predetermined amount of the liquid to be in a dischargeable sate, allows the cap to contact with the nozzle formation plane so as for the suction pump to be operated, and allows the switching mechanism to be operated so as for the predetermined amount at the time of providing the liquid into all the flow-passages to be equal to or more than a liquid amount required for providing the liquid into all the flow-passages and to be equal to or less than a liquid amount obtained by adding a liquid amount required for providing the liquid into all the flow-passages of the downstream side from the choke valve to the liquid amount required for providing the liquid into all the flow-passages.

According to the configuration, since the controller controls the dischargeable liquid amount by the operation of the flow-passage pump to be equal to or more than a liquid amount required for providing the liquid into all the flow-passages and to be equal to or less than a liquid amount obtained by adding a liquid amount required for providing the liquid into all the flow-passages of the downstream side from the choke valve to the liquid amount required for providing the liquid into all the flow-passages, it is possible to reduce the liquid amount which is uselessly discharged.

In the liquid ejecting apparatus according to the invention, the controller allows the switching mechanism to be operated so as for a first selecting operation of allowing supply from the one of the flow-passages of supplying the two types of the liquid to be performed, allows all the flow-passage pumps to be operated so as for a liquid amount required for providing the liquid into all the flow-passages to be in a dischargeable state, allows the cap to contact with the nozzle formation plane so as for the suction pump to be operated so as for first suction of the liquid from the nozzle of the liquid ejecting head to be performed, allows the switching mechanism to be operated so as for a second selecting operation of allowing supply from the other of the flow-passages of supplying the two types of the liquid to be performed, and allows the cap to contact with the nozzle formation plane so as for the suction pump to be operated again so as for second suction of the liquid from the nozzle of the liquid ejecting head to be performed.

According to the configuration, if the flow-passage pump is allowed to be operated and if the cap is allowed to contact with the nozzle formation plane so as for the suction pump to be operated, it is possible to provide the liquid into all the flow-passages except for the flow-passage which is not selected among the flow-passages for supplying the two types of the liquid. At this time, in the other flow-passage, which is not selected, the portions of the downstream side of the switching mechanism is in the state where large negative pressure is exerted by the operation of the suction pump. In addition, in all the flow-passages except for the flow-passage which is not selected, since the subsequent supply of the liquid is not performed by only allowing the flow-passage pump to perform the operation of discharging the liquid amount required for providing the liquid into all the flow-passages, the choke valve is in the closed state by the operation of the suction pump, so that the supply of the liquid is blocked.

On the other hand, in the other flow-passage which is not selected in the above case, the liquid is in the pressed state by the aforementioned operation of the flow-passage pump. After that, if the switching mechanism is allowed to be operated and if the second selecting operation of allowing the supplying of the liquid from the other flow-passage which is not selected in the above case is performed, the negative pressure is exerted to the portions of the downstream side from the switching mechanism and the liquid exists in the pressed state in the other flow-passage which is not selected, so that it is possible to provide the liquid into the other flow-passage which is not selected. In addition, in the second selecting operation, since there is no supply of the liquid from the flow-passage pump in the flow-passages except for the other flow-passage which is not selected, the choke valve is in the closed state, so that it is possible to suppress the liquid from being discharged.

Accordingly, unlike the related art, in the case where the initial providing of the two types of the ink is performed in the liquid ejecting apparatus having the switching mechanism, it is possible to prevent the ink irrelevant to the two types of the ink from being uselessly wasted.

In the liquid ejecting apparatus according to the invention, the controller, after the second suction or at the same time of the second suction, allows all the flow-passage pumps to be operated so as for the liquid of the liquid amount required for providing the liquid into all the flow-passages of the downstream side from the choke valve to be supplied through the flow-passages toward the liquid ejecting head.

According to the configuration, due to the operation of the suction pump, it is possible to remove the negative pressure exerted to the flow-passage of the downstream side from the choke valve. In other words, in the case where the aforementioned negative pressure is not removed, the exertion of the negative pressure may cause a problem in that the liquid discharged into the cap may be flown backward from the nozzle. However, after the second suction by the suction pump or at the same time of the second suction, if the flow-passage pump is allowed to be operated and if the liquid of the liquid amount required for providing the liquid into all the flow-passages of the downstream side from the choke valve is supplied, the negative pressure may be removed, so that it is possible to prevent the liquid from being flown backward from the nozzle.

In the liquid ejecting apparatus according to the invention, the liquid ejecting apparatus includes, at the downstream side from the choke valve, a pressure chamber which the liquid is flown into, a flexible member which is configured to change a volume of the pressure chamber by flexing in response to a change in an internal pressure of the pressure chamber, and a pressure adjusting valve which is configured to be opened in the case where the internal pressure of the pressure chamber is less than a predetermined pressure by the flexing of the flexible member and to be closed in the other cases, wherein the controller, after the second suction or at the same time of the second suction, allows all the flow-passage pumps to be operated so as for the liquid of the liquid amount required for providing the liquid into the pressure adjusting valve and all the flow-passages of the downstream side from the pressure adjusting valve to be supplied through the flow-passages toward the liquid ejecting head.

According to the configuration, due to the operation of the suction pump, it is possible to remove the negative pressure exerted to the pressure adjusting valve and the flow-passage of the downstream side from the pressure adjusting valve. In other words, in the case where the aforementioned negative pressure is not removed, the exertion of the negative pressure may cause a problem in that the liquid discharged into the cap may be flown backward from the nozzle. However, after the second suction by the suction pump or at the same time of the second suction, if the flow-passage pump is allowed to be operated and if the liquid of the liquid amount required for providing the liquid into the pressure adjusting valve and all the flow-passages of the downstream side from the pressure adjusting valve is supplied, the negative pressure may be removed, so that it is possible to prevent the liquid from being flown backward from the nozzle.

According to another aspect of the invention, there is provided a liquid providing method of performing initial providing of a liquid in a liquid ejecting apparatus, wherein the liquid ejecting apparatus includes: a liquid ejecting head which is configured to have a nozzle group of ejecting one type liquid and a nozzle group of ejecting two types of liquid to be capable of ejecting plural types of the liquid from a plurality of the nozzle groups; a cap which is configured to contact with a nozzle formation plane, where the nozzle groups of the liquid ejecting head are exposed, to form one sealing space; a suction pump which is configured to suction the sealing space; a plurality of flow-passages which are configured to supply the plurality types of the liquid from a liquid container toward the liquid ejecting head; a flow-passage pump which is located at the downstream side from the liquid container in the plurality of flow-passages to be capable of suctioning the liquid from the liquid container and discharging the liquid toward the downstream side; a choke valve which is configured to have a valve chamber which is located at the downstream side from the flow-passage pump in the plurality of the flow-passages to allow the liquid to be flown therein, a flexible member which is configured to change a volume of the valve chamber by flexing, and a discharge hole which exists in an inner portion of the valve chamber to be capable of being opened or closed by the flexing of the flexible member, wherein in the case where a predetermined negative pressure or more is exerted to the valve chamber, the flexible member is allowed to close the discharge hole, so that the downstream side thereof is allowed to be in a negative pressure state; a switching mechanism which is located at the downstream side from the choke valve located to two flow-passages among the plurality of the flow-passages and which is connected to one flow-passage for supplying the liquid of the two flow-passages to the nozzle group of ejecting the two types of the liquid to allow supply of some liquid and to block supply of non-selected liquid; a controller which is configured to control operations of the liquid ejecting head, the suction pump, the switching mechanism, and the flow-passage pump, the liquid providing method including: allowing the switching mechanism to be operated so as for a first selecting operation of allowing supply from the one of the flow-passages of supplying the two types of the liquid to be performed; allowing all the flow-passage pumps to be operated so as for a liquid amount required for providing the liquid into all the flow-passages to be in a dischargeable state; allowing the cap to contact with the nozzle formation plane so as for the suction pump to be operated so as for first suction of the liquid from the nozzle of the liquid ejecting head to be performed; allowing the switching mechanism to be operated so as for a second selecting operation of allowing supply from the other of the flow-passages of supplying the two types of the liquid to be performed; and allowing the cap to contact with the nozzle formation plane so as for the suction pump to be operated again so as for second suction of the liquid from the nozzle of the liquid ejecting head to be performed.

According to the configuration, if the flow-passage pump is allowed to be operated and if the cap is allowed to contact with the nozzle formation plane so as for the suction pump to be operated, it is possible to provide the liquid into all the flow-passages except for the flow-passage which is not selected among the flow-passages for supplying the two types of the liquid. At this time, in the other flow-passage, which is not selected, the portions of the downstream side of the switching mechanism is in the state where large negative pressure is exerted by the operation of the suction pump. In addition, in all the flow-passages except for the flow-passage which is not selected, since the subsequent supply of the liquid is not performed by only allowing the flow-passage pump to perform the operation of discharging the liquid amount required for providing the liquid into all the flow-passages, the choke valve is in the closed state by the operation of the suction pump, so that the supply of the liquid is blocked.

On the other hand, in the other flow-passage which is not selected in the above case, the liquid is in the pressed state by the aforementioned one-cycle operation of the flow-passage pump. After that, if the switching mechanism is allowed to be operated and if the second selecting operation of allowing the supplying of the liquid from the other flow-passage which is not selected in the above case is performed, the negative pressure is exerted to the portions of the downstream side from the switching mechanism and the liquid exists in the pressed state in the other flow-passage which is not selected, so that it is possible to provide the liquid into the other flow-passage which is not selected. In addition, in the second selecting operation, since there is no supply of the liquid from the flow-passage pump in the flow-passages except for the other flow-passage which is not selected, the choke valve is in the closed state, so that it is possible to suppress the liquid from being discharged.

Accordingly, unlike the related art, in the case where the initial providing of the two types of the ink is performed in the liquid ejecting apparatus having the switching mechanism, it is possible to prevent the ink irrelevant to the two types of the ink from being uselessly wasted.

In the liquid providing method of performing initial providing of a liquid in a liquid ejecting apparatus according to the invention, the liquid providing method includes after the second suction or at the same time of the second suction, allowing all the flow-passage pumps to be operated so as for the liquid of the liquid amount required for providing the liquid into all the flow-passages of the downstream side from the choke valve to be supplied through the flow-passages toward the liquid ejecting head.

According to the configuration, due to the operation of the suction pump, it is possible to remove the negative pressure exerted to the flow-passage of the downstream side from the choke valve. In other words, in the case where the aforementioned negative pressure is not removed, the exertion of the negative pressure may cause a problem in that the liquid discharged into the cap may be flown backward from the nozzle. However, after the second suction by the suction pump or at the same time of the second suction, if the flow-passage pump is allowed to be operated and if the liquid of the liquid amount required for providing the liquid into all the flow-passages of the downstream side from the choke valve is supplied, the negative pressure may be removed, so that it is possible to prevent the liquid from being flown backward from the nozzle.

In the liquid providing method of performing initial providing of a liquid in a liquid ejecting apparatus according to the invention, the liquid ejecting head includes: at the downstream side from the choke valve, a pressure chamber which the liquid is flown into, a flexible member which is configured to change a volume of the pressure chamber by flexing in response to a change in an internal pressure of the pressure chamber, and a pressure adjusting valve which is configured to be opened in the case where the internal pressure of the pressure chamber is less than a predetermined pressure by the flexing of the flexible member and to be closed in the other cases, wherein the liquid providing method comprises: after the second suction or at the same time of the second suction, allowing all the flow-passage pumps to be operated so as for the liquid of the liquid amount required for providing the liquid into the pressure adjusting valve and all the flow-passages of the downstream side from the pressure adjusting valve to be supplied through the flow-passages toward the liquid ejecting head.

According to the configuration, due to the operation of the suction pump, it is possible to remove the negative pressure exerted to the pressure adjusting valve and the flow-passage of the downstream side from the pressure adjusting valve. In other words, in the case where the aforementioned negative pressure is not removed, the exertion of the negative pressure may cause a problem in that the liquid discharged into the cap may be flown backward from the nozzle. However, after the second suction by the suction pump or at the same time of the second suction, if the flow-passage pump is allowed to be operated and if the liquid of the liquid amount required for providing the liquid into the pressure adjusting valve and all the flow-passages of the downstream side from the pressure adjusting valve is supplied, the negative pressure may be removed, so that it is possible to prevent the liquid from being flown backward from the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printer 10 as a liquid ejecting apparatus according to an embodiment of the invention will be described with reference to FIGS. 1 to 9. In addition, in the description hereinafter, a lower side denotes a chassis side where the printer 10 is disposed, and an upper side denotes a side which is separated from the side where the printer 10 is disposed. In addition, a direction of movement of a carriage 31 is set to a main-scan direction, and a direction which is perpendicular to the main-scan direction and which a printing medium P is to be transported is set to a sub-scan direction. In addition, a side to which the printing medium P is fed is denoted by a sheet feeding side, and a side from which the printing medium P is discharged is denoted by a sheet discharging side.

Schematic Configuration of Printer

Figure 1:
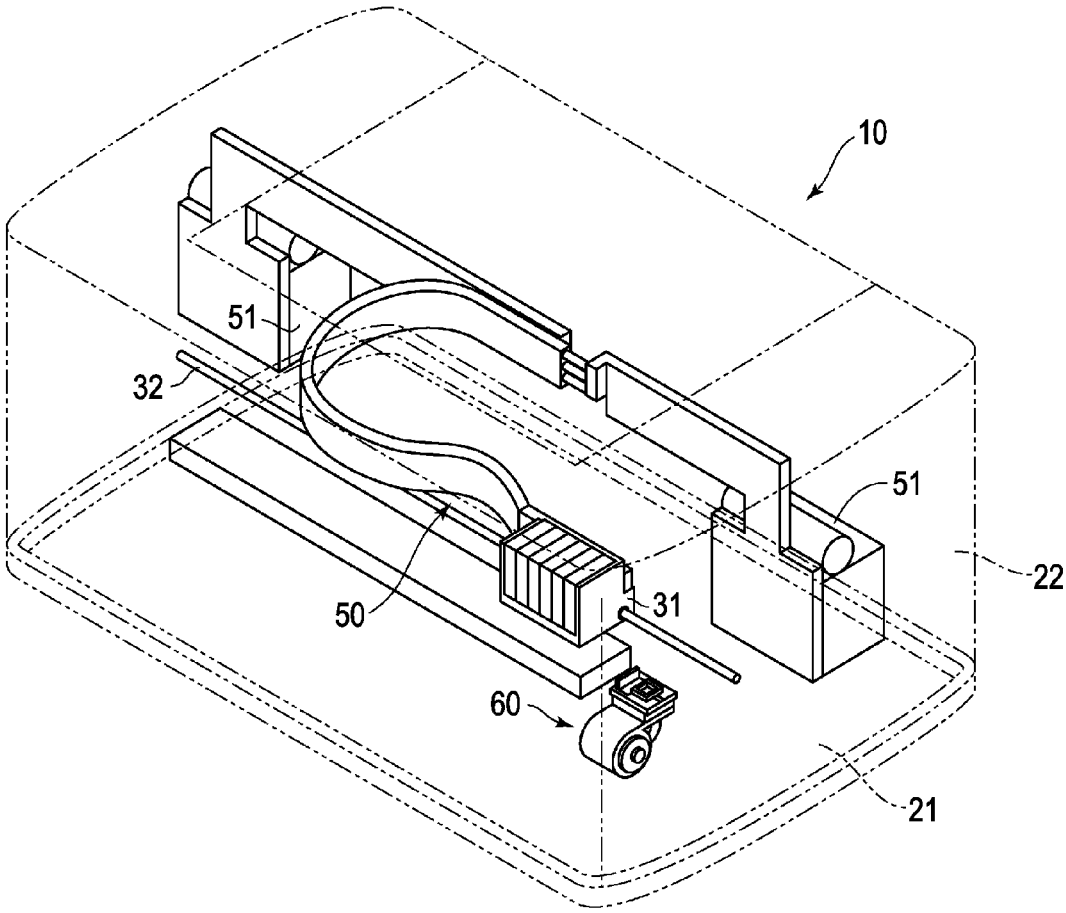
FIG. 1 is a perspective view illustrating a configuration of a printer according to an embodiment of the invention.

First, a schematic configuration of the printer 10 is described. FIG. 1 is a perspective view illustrating a schematic configuration of the printer 10 according to an embodiment of the invention, wherein an upstream side (sheet feeding side) of sheet transporting is disposed at the front side, and a downstream side (sheet discharging side) of the sheet transporting is disposed at the rear side. In addition, FIG. 2 is a schematic diagram illustrating the configuration of the printer 10.

The printer 10 according to the embodiment includes a chassis 21, a housing 22, a carriage mechanism 30, a sheet transporting mechanism 40, an ink supply mechanism 50, a cleaning mechanism 60, and a controller 70, Among these components, the chassis 21 is a portion of which the lower surface side is in contacted with an installation surface and on which various units are mounted. In addition, the housing 22 indicated by a two-dot dashed line in FIG. 1 is mounted on the chassis 21. The housing 22 has the same planar shape as that of the aforementioned chassis 21.

Figure 2:
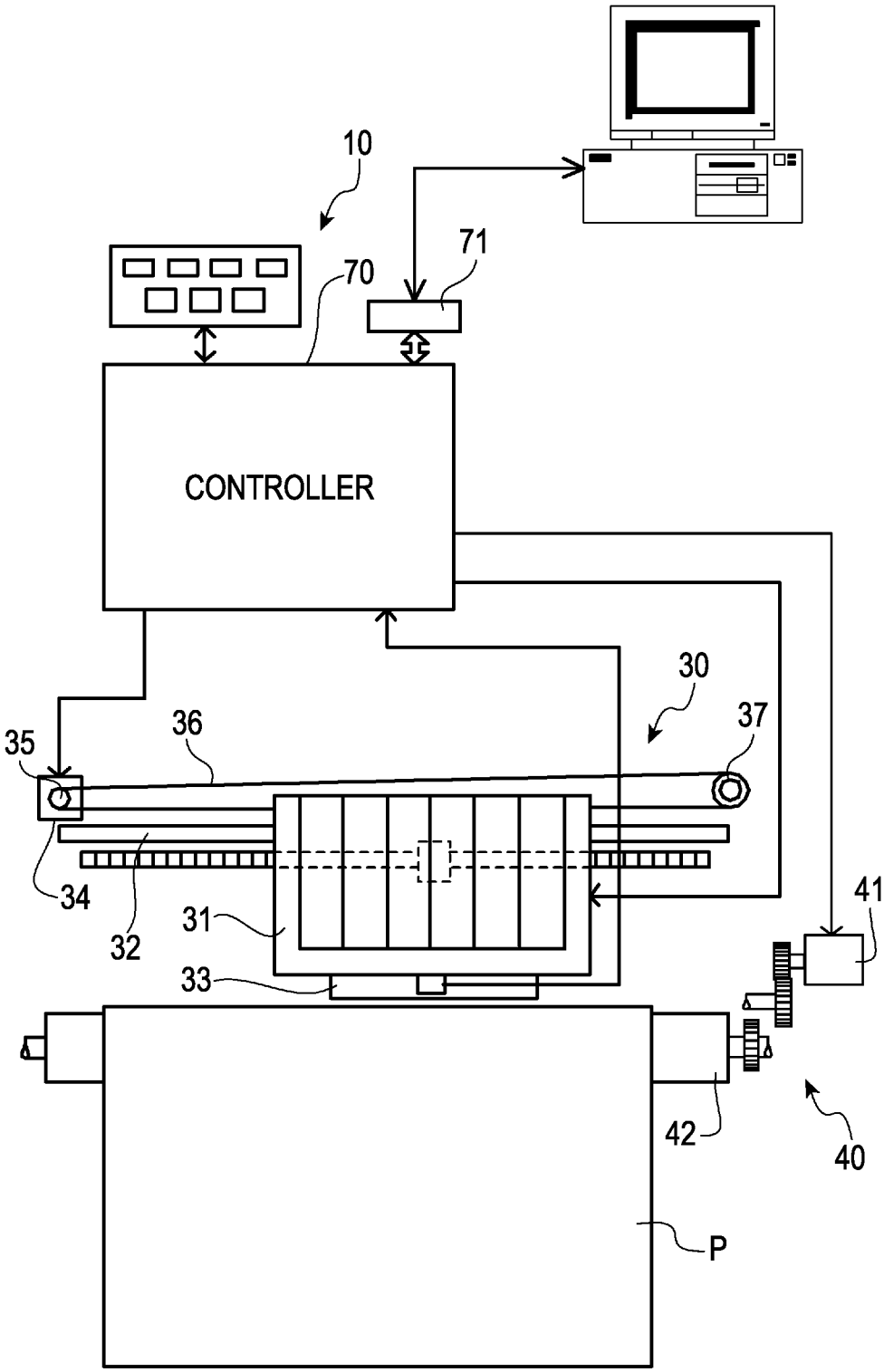
FIG. 2 is a schematic diagram illustrating a configuration of a printer.

In addition, as illustrated in FIGS. 1 and 2, the carriage mechanism 30 includes a carriage 31, a carriage shaft 32 on which the carriage 31 slidingly moves, and a print head 33. In addition, the carriage mechanism 30 includes a carriage motor (CR motor) 34, a gear pulley 35 which is attached to the CR motor 34, a driven pulley 37, and an endless belt 36 which is suspended between the gear pulley 35 and the driven pulley 37. Ink (corresponding to the liquid) supplied through the later-described ink supply mechanism 50 is ejected from the print head 33 (corresponding to an ejecting head) to the printing medium P.

In addition, as illustrated in FIG. 2, the sheet transporting mechanism 40 includes a sheet transporting motor (PF motor) 41, a feed roller 43 of which the driving force is transmitted from the sheet transporting motor 41, and the like.

In addition, in FIG. 1, for example, a so-called off-carriage type printer 10, where the ink cartridge 51 (corresponding to a liquid container) is mounted on the chassis 21 side, is illustrated. However, the printer is not limited to the off-carriage type, a so-called on-carriage type printer, where the ink cartridge is mounted on the carriage, may be used.

Herein, in the embodiment, the ink cartridge 51 includes an ink cartridge of storing cyan (indicated by C in FIG. 3), magenta (indicated by M in FIG. 3), yellow (indicated by Y in FIG. 3) and an ink cartridge of storing two types of black ink. The two types of black ink are, for example, a photo black (indicated by PK in FIG. 3) ink for implementing high glossiness printing on a glossy paper and a matt black (indicated by MK in FIG. 3) ink suitable for a matt paper having no glossiness.

In addition, the aforementioned print head 33 is provided with nozzle groups of a nozzle 33*a* (refer to FIG. 3) for ejecting the cyan ink, a nozzle 33*a* for ejecting the magenta ink, and a nozzle 33*a* for ejecting the yellow ink. In addition, there is only one nozzle 33*a* for ejecting the black ink (in other words, the nozzle is shared by the two types of black ink.), so that the black ink selected between the two types of the ink by the later-described switching mechanism 58 is ejected.

Ink Supply Mechanism

Figure 3:
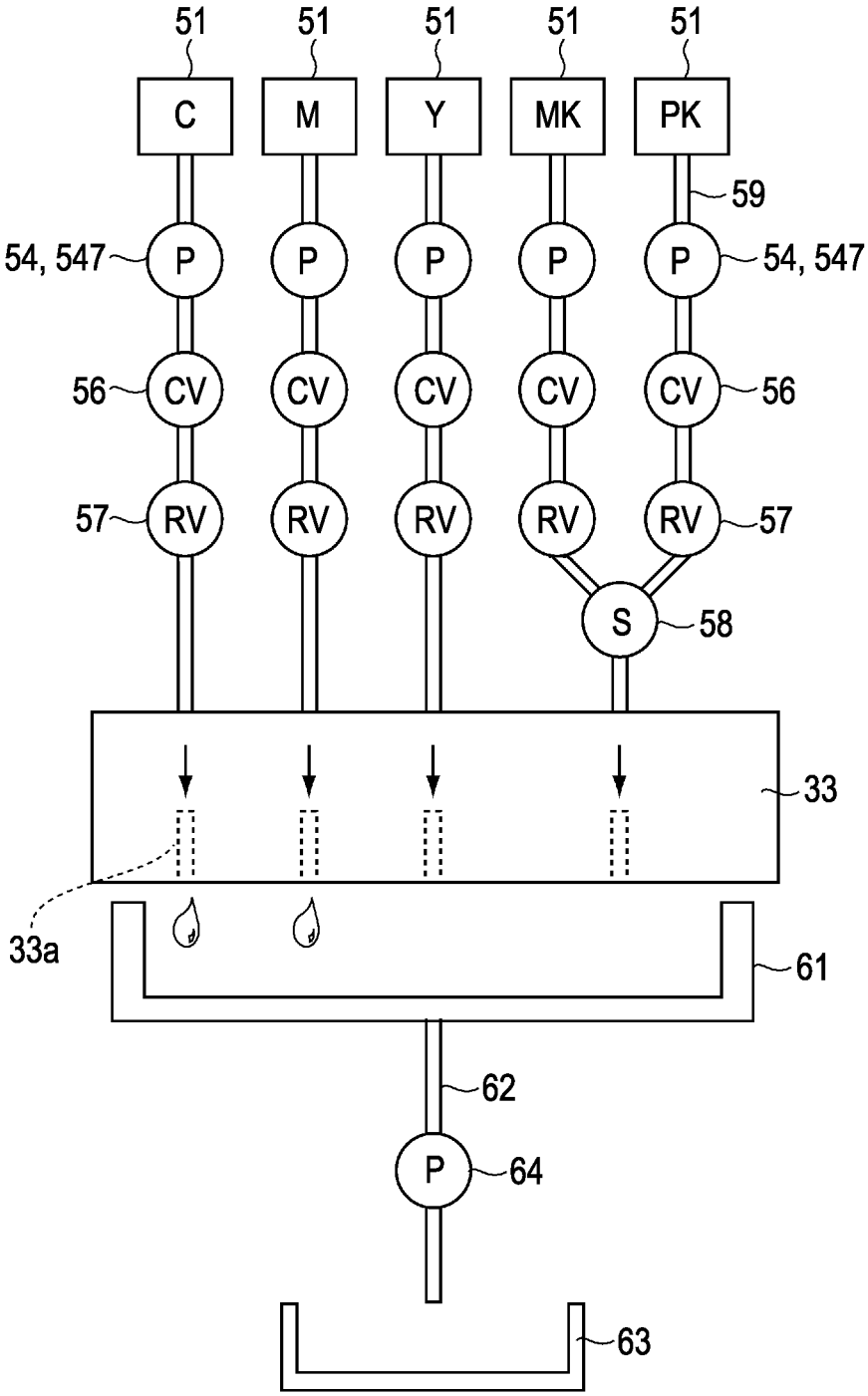
FIG. 3 is a schematic diagram illustrating an ink supply mechanism and a cleaning mechanism.
Figure 4:
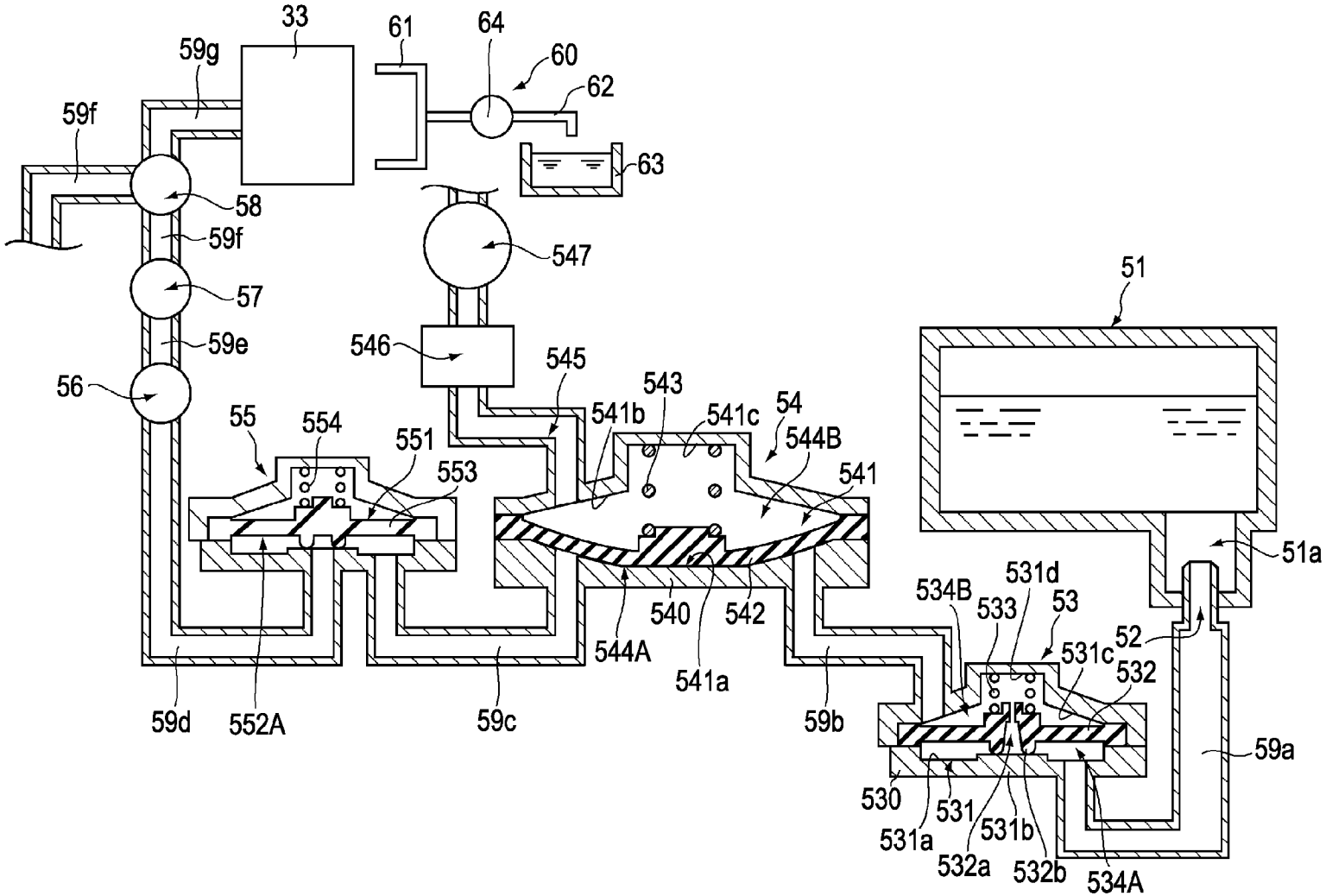
FIG. 4 is a diagram illustrating a schematic configuration of an ink supply mechanism and configurations of a flow-passage pump and a check valve.

Next, a configuration of the ink supply mechanism 50 is described with reference to FIGS. 3 to 7. FIGS. 3 and 4 are diagrams illustrating the entire flow of the ink supply mechanism 50 and the cleaning mechanism 60. The ink supply mechanism 50 includes, as main components, an ink supply needle 52, a first check valve 53, a flow-passage pump 54, a second check valve 55, a choke valve 56, a pressure adjusting valve 57, a switching mechanism 58, and first to seventh flow-passages 59*a* to 59*g*.

In addition, the first to seventh flow-passages 59*a* to 59*g* may be referred to as flow-passages 59 if these flow-passages are not necessarily to be distinguished.

As illustrated in FIG. 3, the flow-passage pump 54, the choke valve 56, and the pressure adjusting valve 57 in the ink supply mechanism 50 are provided to each ink cartridge 51. In addition, although not illustrated in FIG. 3, the first check valve 53 and the second check valve 55 are provided to each flow-passage pump 54. However, as described later, since the switching mechanism 58 illustrated in FIG. 3 is a device of allowing any one of the photo black ink and the matt black ink to be flown into the seventh flow-passage 59*g* illustrated in FIG. 4, the switching mechanism 58 is connected to the sixth flow-passage 59*f* for flowing the photo black ink and connected to the sixth flow-passage 59*f* for flowing the matt black ink, and the other ink cartridges 51 are not connected to the sixth flow-passage 59*f*.

The ink supply needle 52 is a portion of insertion into the an ink supply inlet 51*a* of the ink cartridge 51, and due to the insertion, the ink supply needle 52 and the ink supply inlet 51*a* are connected to each other in the state that the ink may be able to be flown.

The first check valve 53 is a member of allowing the ink to flowing from the ink cartridge 51 to the downstream side but preventing the ink from returning from the flow-passage pump 54 to the ink cartridge 51. As illustrated in FIG. 4, the first check valve 53 includes an internal space 531 formed by the housing 530, a flexible valve 532, and a biasing spring 533. In the internal space 531, a valve seat 531*b* is disposed to a bottom portion 531*a*, and a spring receiving portion 531*d* is disposed to a top portion 531*c* opposite to the bottom portion 531*a*. In the internal space 531, the flexible valve 532 is disposed, and the flexible valve 532 may be flexible (deformable) so as to be detachable to the valve seat 531*b*. Due to the existence of the flexible valve 532, the internal space 531 is partitioned into an upstream chamber 534A which communicates with the first flow-passage 59*a* supplied with the ink from the ink cartridge 51 and a downstream chamber 534B which communicates with the second flow-passage 59*b* for supplying the ink to the flow-passage pump 54.

In addition, a through-hole 532*a* is disposed at the center of the flexible valve 532 in the diameter direction thereof. In addition, the flexible valve 532 is provided with a ring-shaped protrusion 532*b* which is disposed to protrude toward the valve seat 531*b* and to surround the through-hole 532*a*. When the protrusion 532*b* is not in contact with the valve seat 531*b*, the ink which is flown into the upstream chamber 534A passes through the through-hole 532*a* and the downstream chamber 534B to be flown into the second flow-passage 59*b*.

In addition, a biasing force being directed toward the valve seat 531*b* is exerted to the flexible valve 532 by the biasing spring 533. The one end side of the biasing spring 533 is allowed to contact with the spring receiving portion 531*d*, and the outer end side thereof is allowed to contact with the flexible valve 532. Therefore, the biasing spring 533 exerts a biasing force for forcing the flexible valve 532 to be directed toward the valve seat 531*b*. In addition, due to the biasing force, in the state where a negative pressure or the like is not exerted to the downstream chamber 534B, the protrusion 532*b* is allowed to contact with the valve seat 531*b*.

In addition, a flow-passage pump 54 is disposed at the downstream side from the first check valve 53 through the second flow-passage 59*b*. The flow-passage pump 54 includes an internal space 541 which is formed by the housing 540, a diaphragm 542, and a coil spring 543. Due to the existence of the diaphragm 542, the internal space 541 may be partitioned into two portions, that is, a pump chamber 544A and a negative pressure chamber 544B. The pump chamber 544A is configured to communicate with the second flow-passage 59*b* and to communicate with the third flow-passage 59*c*. The third flow-passage 59*c* is a flow-passage which is located at the downstream side from the flow-passage pump 54 as seen in the order of the ink supply passages toward the print head 33 and which is configured to communicate with the second check valve 55. In addition, in the internal space 541, the diaphragm 542 is flexible (deformable) so as to be allowed to contact with the bottom portion 541*a* of the pump chamber 544A and flexible (deformable) so as to be allowed to contact with the top portion 541*b* of the negative pressure chamber 544B.

In addition, a spring receiving portion 541*c* is disposed to the top portion 541*b* of the negative pressure chamber 544B. The one end side of the coil spring 543, which exerts an external force to the pump chamber 544A is allowed to contact with the spring receiving portion 541*c*. In addition, the other end side of the coil spring 543 is allowed to contact with the diaphragm 542. Therefore, a biasing force for allowing the diaphragm 542 to contact with the bottom portion 541*a* of the pump chamber 544A is exerted to the diaphragm 542 by the coil spring 543. In addition, due to the biasing force, in the state where the later-described negative pressure is not exerted to the negative pressure chamber 544B, the diaphragm 542 is allowed to contact with the bottom portion 541*a* of the pump chamber 544A, so that the flow of the ink being directed toward the downstream side is blocked.

Herein, an atmospheric opening valve 546 is connected through the air flow-passage 545 to the negative pressure chamber 544B. In the state where a valve structure (not shown) is closed, the atmospheric opening valve 546 blocks an inflow of air being directed from an external portion to the negative pressure chamber 544B. If the later-described depressurizing pump 547 is operated to be in the blocked state, a negative pressure may be exerted to the negative pressure chamber 544B. Therefore, due to the function of the negative pressure, the diaphragm 542 may be allowed to oppose against the spring force of the coil spring 543 and to be separated from the bottom portion 541*a* of the pump chamber 544A. In addition, the side separated from the negative pressure chamber 544B rather than the atmospheric opening valve 546 of the air flow-passage 545 is connected to the depressurizing pump 547. The depressurizing pump 547 is a pump which is driven to exert a negative pressure to the negative pressure chamber 544B. In addition, the driving of the depressurizing pump 547 is controlled by the controller 70.

In addition, although the configuration of the second check valve 55 is similar to the configuration of the aforementioned first check valve 53, the second check valve 55 is different from the first check valve 53 in that the through-hole is not formed in the second check valve 55. In addition, in the second check valve 55, the third flow-passage 59*c* at the upstream side is configured to always communicate with the inflow chamber 552A. The flexible valve 553 of the second check valve 55 is biased by the biasing member 554 in the valve-closing direction for closing the fourth flow-passage 59*d*. Therefore, in the case where the pressure of the inflow chamber 552A is less than a predetermined pressure as well as in the case where the inflow chamber 552A is in the negative pressure state, the flexible valve 553 of the second check valve 55 is not opened, so that the backward flow of the ink to the third flow-passage 59*c* is prevented. In addition, the ink is flown from the third flow-passage 59*c* of the upstream side into the inner portion of the inflow chamber 552A of the second check valve 55, so that the pressure of the inflow chamber 552A may be equal to or larger than a predetermined pressure. In this case, the flexible valve 553 of the second check valve 55 resists the pressing force of the biasing member 554 to be deformed in the direction of allowing the internal volume of the inflow chamber 552A to increase, so that the flexible valve 553 is opened. Therefore, the fourth flow-passage 59*d* of the downstream side communicates with the third flow-passage 59*c* of the upstream side through the inner portion of the inflow chamber 552A. In addition, description of the same components of the second check valve 55 as those of the first check valve 53 is omitted.

Figure 5:
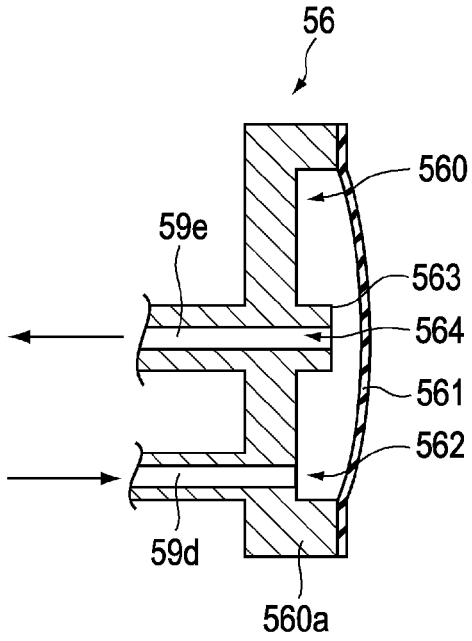
FIG. 5 is a schematic cross-sectional view illustrating a configuration of a choke valve.

In addition, a choke valve 56 is disposed along the fourth flow-passage 59*d* toward the downstream side. As illustrated in FIG. 5, the choke valve 56 includes a concave portion 560 formed by a molding product 560*a* and a film 561 (corresponding to a flexible member). The concave portion 560 is configured to communicate with the fourth flow-passage 59*d*. In addition, the concave portion 560 is formed to be depressed more deeply than other portions except for the later-described annular convex portion 563. In addition, by attaching a film 561 so as to cover the concave portion 560, the choke valve chamber 562 is configured. An annular convex portion 563 is disposed at the center or substantially center of the choke valve chamber 562 (concave portion 560) in the diameter direction thereof. The annular convex portion 563 is configured to protrude up to the same level as the portion other than the concave portion 560 in the molding product 560*a*. In the annular convex portion 563, a contacting portion which the film 561 is attached/detached to/from is disposed in the vicinity of the later-described discharge hole 564. In addition, the film 561 is flexible (deformable) so that the film 561 is attached/detached to/from the annular convex portion 563.

In addition, the annular convex portion 563 is provided with a discharge hole 564 which is an inlet of the fifth flow-passage 59*e*. In other words, in the state where the film 561 is not in contact with the annular convex portion 563, the discharge hole 564 is in the opened state, so that the flow of the ink toward the fifth flow-passage 59*e* is allowed. However, if the film 561 is allowed to contact with the annular convex portion 563 due to the decrease in the internal pressure of the choke valve chamber 562, the discharge hole 564 is in the closed state, the flow of the ink toward the fifth flow-passage 59*e* is blocked. According to such a configuration, the function as the choke valve 56 may be implemented.

Figure 6:
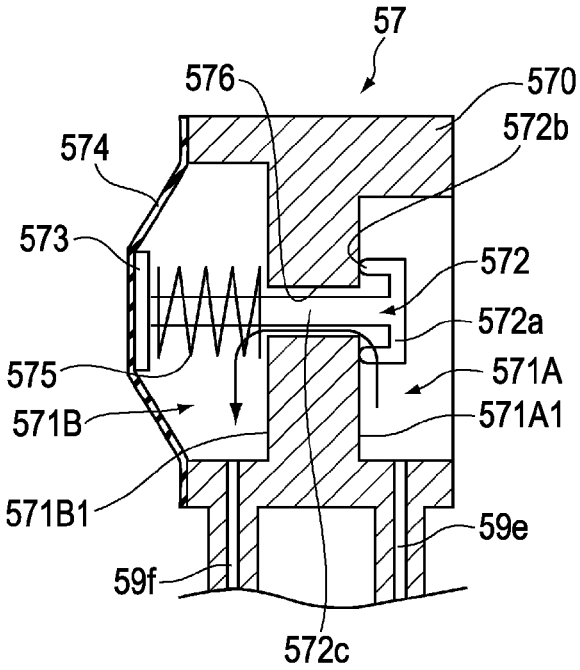
FIG. 6 is a schematic cross-sectional view illustrating a configuration of a pressure adjusting valve.

In addition, a pressure adjusting valve 57 is disposed along the fifth flow-passage 59*e* toward the downstream side. As illustrated in FIG. 6, the pressure adjusting valve 57 includes an ink supply chamber 571A and a pressure chamber 571B which are formed by the housing 570, a valve structure 572, a plate-shaped member 573, a film 574, and a biasing spring 575. The ink supply chamber 571A is a portion into which the ink is flown from the fifth flow-passage 59*e* and which is configured to communicate with the pressure chamber 571B through the communicating hole 576. In addition, the sealing portion 572*a* of the valve structure 572 is located in the ink supply chamber 571A. The sealing portion 572*a* is provided with a protrusion 572*b*. The protrusion 572*b* is configured to have a ring shape of surrounding the bottom portion of the outer side from the outer circumference of the communicating hole 576 (the side wall of the side of the ink supply chamber 571A where the communicating hole 576 is formed is denoted by the bottom portion 571A1). Therefore, if the protrusion 572*b* is in contact with the bottom portion 571A1 of the ink supply chamber 571A, the periphery of the communicating hole 576 is closed by the protrusion 572*b*, so that the flow of the ink toward the communicating hole 576 is blocked.

In addition to the aforementioned sealing portion 572*a*, a shaft portion 572*c* is provided to the valve structure 572. As illustrated in FIG. 6, the shaft portion 572*c* is a portion which is inserted into the communicating hole 576 and of which the front end portion is configured to protrude to the pressure chamber 571B. The front end portion of the shaft portion 572*c* is connected to the plate-shaped member 573. In addition, the plate-shaped member 573 is adhered to the film 574. In addition, the film 574 is flexed (deformed) according to the change in the pressure of the pressure chamber 571B, so that a volume of the pressure chamber 571B may be changed. In addition, in the pressure chamber 571B, a portion facing the film 574 becomes a bottom portion 571B1.

In addition, between the plate-shaped member 573 and the bottom portion 571B1 of the pressure chamber 571B, a biasing spring 575 is disposed. The biasing spring 575 exerts a biasing force for separating the film 574 from the bottom portion 571B1 of the pressure chamber 571B. In other words, in the state where a negative pressure is not exerted to the pressure chamber 571B (in the state where a sufficient amount of ink exists), the film 574 is separated from the bottom portion 571B1 by the biasing force exerted from the biasing spring 575. Due to the separating operation, the valve structure 572 is moved to the film 574, and the protrusion 572*b* is allowed to contact with the periphery of the communicating hole 576 in the bottom portion 571A1, so that the periphery of the communicating hole 576 is closed. Therefore, the flow of the ink toward the communicating hole 576 is blocked. On the contrary, due to the ink ejection of the print head 33, if the ink is consummated, the amount of the ink of the inner portion of the pressure chamber 571B is decreased, so that the film 574 is flexed toward the ink supply chamber 571A by the corresponding amount. At this time, as the pressure difference between the internal pressure of the pressure chamber 571B and the atmospheric pressure is increased so that the biasing force of the biasing spring 575 may be able to be opposed, the film 574 and the valve structure 572 are moved toward the right side in FIG. 6, so that the protrusion 572*b* is separated from the bottom portion 571A1. Accordingly, the ink is supplied from the ink supply chamber 571A to the pressure chamber 571B through the communicating hole 576. If a predetermined amount of the ink is supplied, the film 574 is moved to the side so as to be separated from the bottom portion 571B1.

Figure 7:
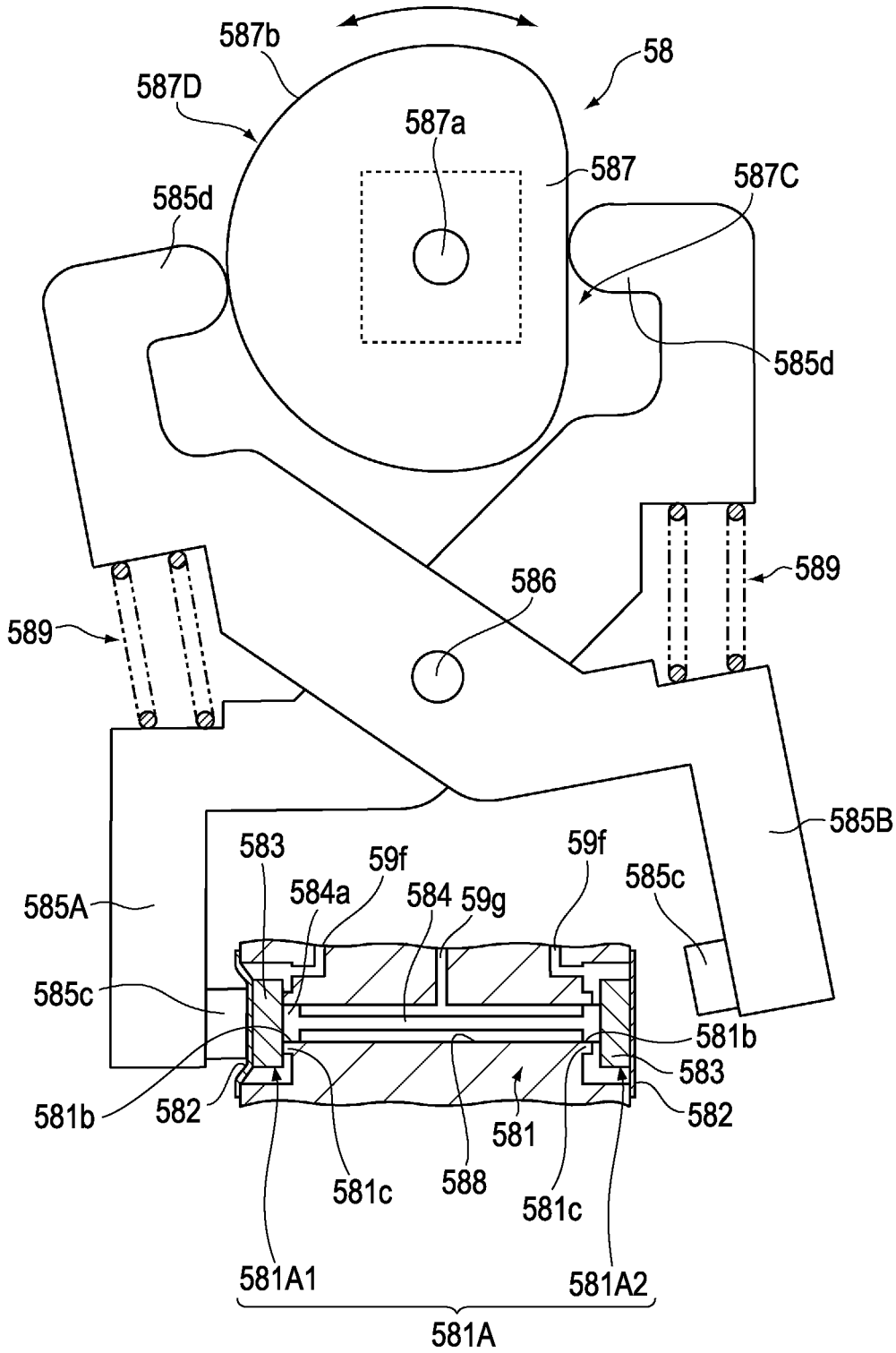
FIG. 7 is a schematic diagram illustrating a configuration of a switching mechanism.

In addition, as directing toward the downstream along the sixth flow-passage 59*f* of flowing two types of black ink, a switching mechanism 58 is disposed as illustrated in FIG. 7. The switching mechanism 58 may switch the ink ejected from the nozzle 33*a* of the print head 33 between the photo black ink and the matt black ink according to whether the printing medium P is, for example, a glossy paper or, for example, matt paper.

As illustrated in FIG. 7, the switching mechanism 58 includes a main body 581, a film 582, a sealing member 583, a shaft member 584, a first arm 585A and a second arm 585B, and a plate cam 587. The main body 581 is provided with a pair of recessed fitting portions 581A (581A1 and 581A2). Each of the pair of the recessed fitting portions 581A is configured to communicate with the corresponding sixth flow-passage 59*f*.

Herein the one recessed fitting portion 581A1 is configured to communicate with the sixth flow-passage 59*f* for supplying, for example, the photo black ink. In addition, the other recessed fitting portion 581A2 is configured to communicate with the sixth flow-passage 59*f* for supplying the matt black ink. In addition, a ring-shaped valve seat 581*c* which further protrudes in comparison with other portions of the bottom portion 581*b* is disposed to the bottom portion 581*b* of the recessed fitting portion 581A, and the insertion hole 588 is formed at the center of the valve seat 581*c*. Although the sealing member 583 is inserted into the recessed fitting portion 581A, in the state where the sealing member 583 is separated from the valve seat 581*c*, the flow of the ink from the recessed fitting portion 581A to the insertion hole 588 is allowed. On the contrary, in the state where the sealing member 583 is allowed to contact with the valve seat 581*c*, the flow of the ink from the recessed fitting portion 581A to the insertion hole 588 is blocked.

In addition, the sealing member 583 is attached to the film 582 which liquid-tightly covers the recessed fitting portion 581A. Therefore, the ink is flown into the recessed fitting portion 581A, the film 582 is flexed in such a direction that the sealing member 583 is separated from the valve seat 581*c* by the flexing.

The aforementioned insertion hole 588 is connected to the seventh flow-passage 59*g*, so that the ink may be supplied through the seventh flow-passage 59*g* to the print head 33. In addition, the shaft member 584 is inserted into the insertion hole 588. The length of the shaft member 584 is slightly larger than the length of the insertion hole 588. Therefore, in the state where the one sealing member 583 is inserted so as to contact with the valve seat 581*c*, the other sealing member 583 is separated from the valve seat 581*c* by the shaft member 584. In addition, although two end portions of the shaft member 584 become enlarged diameter portions 584*a* of which the diameter is larger than other portions, the diameter of each of the enlarged diameter portions 584*a* has a size corresponding to an inner diameter of the insertion hole 588. However, since a portion of the enlarged diameter portion 584*a* in the principal direction is notched (not shown), the flow of the ink to the insertion hole 588 is allowed due to the existence of the cut portion.

In addition, as illustrated in FIG. 7, the first arm 585A and the second arm 585B are disposed to intersect each other, and the pin 586 which passes through the two arms is disposed at the intersecting portion. Therefore, the first arm 585A and the second arm 585B may be rotated by the pin 586. Between the first arm 585A and the second arm 585B, the one end side near to the recessed fitting portion 581A becomes the pressing portion 585*c* for pressing the sealing member 583.

In addition, between the first arm 585A and the second arm 585B, the other end side being separated from the recessed fitting portion 581A becomes the cam contacting portion 585*d* which is allowed to contact with the plate cam 587. The plate cam 587 is installed so that the distance from the rotation shaft 587*a* to the cam plane 587*b* is changed. Therefore, a pressing area 587C and a separating area 587D exist therein. In other words, the pressing area 587C is an area where the cam plane 587*b* is nearest to the rotation shaft 587*a* which is the center of rotation and a portion where, when the sealing member 583 is pressed by the pressing portion 585*c*, the cam contacting portion 585*d* is allowed to contact with the cam plane 587*b*. In addition, the separating area 587D is an area where the cam plane 587*b* is farthest from the rotation shaft 587*a* which is the center of rotation and a portion where, when the pressing portion 585*c* is separated from the sealing member 583, the cam contacting portion 585*d* is allowed to contact with the cam plane 587*b*.

In addition, the spring members 589 are provided between the cam contacting portion 585*d* from the pin 586 in the first arm 585A and the pressing portion 585*c* from the pin 586 in the second arm 585B and between the pressing portion 585*c* from the pin 586 in the first arm 585A and the cam contacting portion 585*d* from the pin 586 in the second arm 585B. The spring members 589 exert a biasing force to each other in such a direction that the installation portions are separated from each other. Therefore, the cam contacting portion 585*d* of the first arm 585A and the cam contacting portion 585*d* of the second arm 585B are allowed to simultaneously contact with the plate cam 587.

If the plate cam 587 is rotated by a motor (not shown) driven by the above switching mechanism 58, the one of the pressing portion 585*c* of the first arm 585A and the pressing portion 585*c* of the second arm 585B presses the sealing member 583, so that the sealing member 583 is allowed to contact with the valve seat 581*c* of the one recessed fitting portion 581A. Therefore, the flow of the ink to the insertion hole 588 is blocked. At the same time, the other of the pressing portion 585*c* of the first arm 585A and the pressing portion 585*c* of the second arm 585B is separated from the sealing member 583. Therefore, if the flow of the ink into the other recessed fitting portion 581A causes the flexing of the film 582, the sealing member 583 is not allowed to contact with the valve seat 581*c*. Accordingly, the ink is allowed to flow through the insertion hole 588 toward the seventh flow-passage 59*g*. In addition, the seventh flow-passage 59*g* is configured to communicate with the nozzle 33*a* of the print head 33.

Cleaning Mechanism

Subsequently, the cleaning mechanism 60 is described. The chassis 21 is provided with the cleaning mechanism 60 as illustrated in FIGS. 1, 3, and 4. The cleaning mechanism 60 includes a cap 61, an ink discharge tube 62, a waste tank 63, and a suction pump 64.

Among these components, the cap 61 is a portion which seals the nozzle formation plane (not shown) where the nozzle 33*a* as the nozzle group of the print head 33 to form one sealing space. Therefore, the cap 61 may be lifted up and down by a lifting mechanism (not shown). In addition, the one end side of the ink discharge tube 62 is connected to the cap 61, and the other end side thereof is connected to the waste tank 63. In addition, the waste tank 63 is a portion which stores the ink discharged from the nozzle 33*a* of the print head 33 to the cap 61. In addition, the suction pump 64 is connected to an intermediate portion of the ink discharge tube 62. Therefore, if the suction pump 64 is operated, the ink may be discharged from the nozzle 33*a* toward the waste tank 63.

Controller

As illustrated in FIG. 2, the printer 10 is provided with a controller 70. The controller 70 includes an interface 71 and a CPU, a memory, an ASIC (Application Specific Integrated Circuit), a bus, a timer, and the like which are not shown. In addition, the controller 70 is input with signals from various sensors, and the controller 70 controls driving of a CR motor 34, a PF motor 41, a pump motor (not shown) of a depressurizing pump 547, a pump motor (not shown) of a suction pump 64, a print head 33, and the like based on the signals from the sensors or irrespective of the sensors. In addition, programs and data used for controlling the driving are stored in a memory.

Operations at Time of Initially Providing Ink in Print Head

Subsequently, operations at the time of initially providing the ink in the print head 33 in the printer 10 having the aforementioned configuration are described with reference to FIGS. 8A and 8B and FIGS. 9A to 9C.

First Initial Providing

1. Operations of Depressurizing pump 547 (Generation of Negative Pressure)

If the initial providing operation is selected in the controller 70, the controller 70 performs a selecting operation so that any one black ink is supplied to the nozzle 33*a* (first selecting operation). In other words, the controller 70 drives the switching mechanism 58 to allow the plate cam 587 to be rotated due to operation of a motor (not shown), so that the pressing portion 585*c* of the one side is separated from the sealing member 583 and so that the pressing portion 585*c* of the other side presses the sealing member 583. Accordingly, in the recessed fitting portion 581A for supplying the black ink of the one side, the sealing member 583 is separated from the valve seat 581*c*, so that the black ink of the one side is supplied. However, in the recessed fitting portion 581A for supplying the black ink of the other side, the sealing member 583 is allowed to contact with the valve seat 581*c*, so that the black ink of the other side is blocked not to be supplied.

Figure 8A:
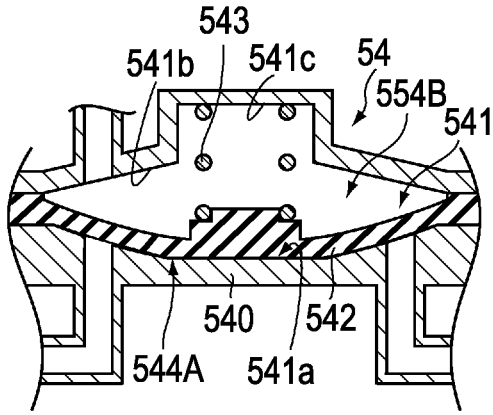
FIGS. 8A and 8B are diagrams illustrating behavior of an operation of a flow-passage pump.
Figure 8B:
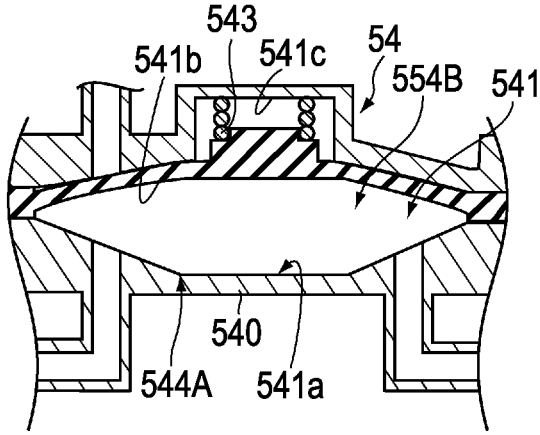

After the selection is performed, the controller 70 allows the depressurizing pump 547 to be operated. At this time, the atmospheric opening valve 546 is in the closed state. Accordingly, the pressure of the negative pressure chamber 544B becomes a negative pressure by the depressurizing pump 547, the diaphragm 542 is flexed from the state where it is allowed to contact with the bottom portion 541*a* of the pump chamber 544A as illustrated in FIG. 4 to the state where it is allowed to contact with the top portion 541*b* of the negative pressure chamber 544B as illustrated in FIG. 8B.

At this time, the flexible valve 553 of the second check valve 55 is in the state of closing the fourth flow-passage 59*d* due to the function of the negative pressure, so that no negative pressure is exerted to the flow-passages of the downstream side therefrom. On the other hand, the pump chamber 544A is also in the negative pressure state, so that the negative pressure is exerted to the first check valve 53 through the second flow-passage 59*b*. At this time, the downstream chamber 534B of the first check valve 53 is in a negative pressure state, so that the flexible valve 532 is flexed so as to oppose the biasing force of the biasing spring 533 due to the negative pressure. Therefore, the protrusion 532*b* is separated from the valve seat 531*b*, so that the negative pressure is exerted to the ink cartridge 51 through the upstream chamber 534A and the first flow-passage 59*a*. Accordingly, the ink stored in the ink cartridge 51 is flown into the upstream chamber 534A through the first flow-passage 59*a*. In addition, if the ink is flown into the upstream chamber 534A, the flexible valve 532 maintains the state where the flexible valve 532 is pressed up to the downstream chamber 534B. The ink is flown into the downstream chamber 534B through the through-hole 532*a*. Sequentially, the ink is flown from the downstream chamber 534B through the second flow-passage 59*b* into the pump chamber 544A. In addition, the ink is also inserted into the third flow-passage 59*c*.

Figures 9A, 9B, 9C:
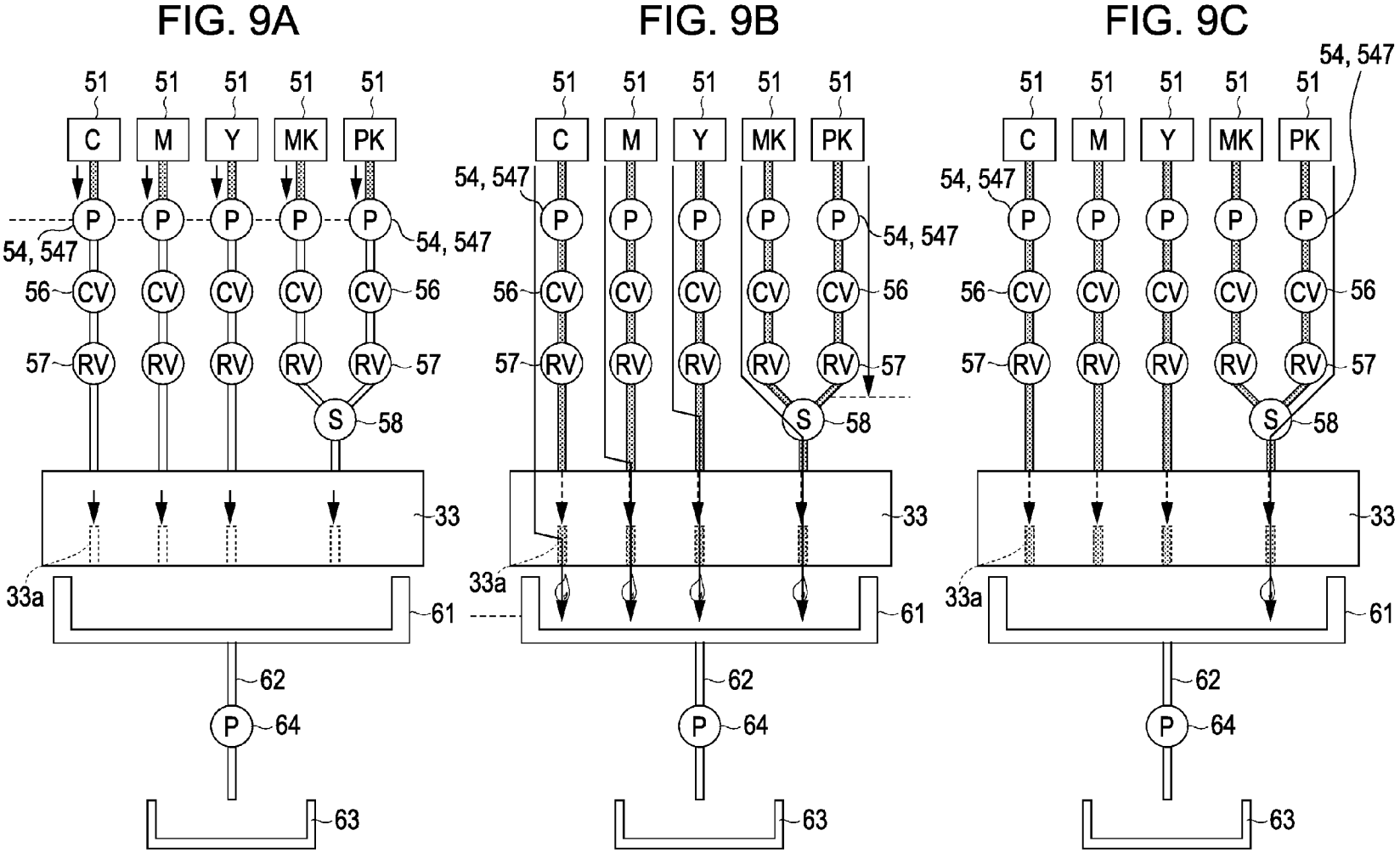
FIGS. 9A to 9C are diagrams illustrating behavior of ink supply from a cartridge to a print head.

In addition, the flow of the ink into the pump chamber 544A and the third flow-passage 59*c* are performed with respect to all the ink cartridges 51. In other words, both of the photo black ink and the matt black ink are flown into the pump chamber 544A and the third flow-passage 59*c*, respectively. In addition, the behavior of the ink being directed toward the downstream side at this time is illustrated in FIG. 9A.

2. Operations of Suction Pump

As described above, by the control of the controller 70, in the state where the diaphragm 542 is in contact with the top portion 541*b* of the negative pressure chamber 544B, subsequently, the suction pump 64 is allowed to be operated (first suction). As a result, with respect to the pressure adjusting valve 57, the pressure chamber 571B is in a negative pressure state, so that the film 574 is flexed toward the ink supply chamber 571A due to the negative pressure. Accordingly, since the valve structure 572 is inserted into the ink supply chamber 571A by opposing the spring force of the biasing spring 575, the protrusion 572*b* is separated from the bottom portion 571A1, so that the ink supply chamber 571A is allowed to communicate with the pressure chamber 571B through the communicating hole 576. Therefore, a negative pressure is also exerted to the ink supply chamber 571A, and the negative pressure is exerted to the choke valve chamber 562 of the choke valve 56 through the fifth flow-passage 59*e* and the discharge hole 564.

In addition, the choke valve chamber 562 is in a negative pressure state, so that the film 561 is flexed toward the bottom portion of the concave portion 560. Due to the flexing operation, the film 561 is in contact with the annular convex portion 563. As a result, the periphery of the discharge hole 564 is closed by the film 561, and due to the operation of an additional suction pump 64, the film 561 is allowed to be strongly pressed to the annular convex portion 563 by large pressure. On the other hand, the portions (the fifth flow-passage 59*e*, the pressure adjusting valve 57, and the sixth flow-passage 59*f* or the like) of the downstream side from the discharge hole 564 are in large negative pressure state due to the operation of the suction pump 64. In addition, the reaching points of the ink at this time are illustrated in FIG. 9A.

3. Atmospheric Opening

Subsequently, by the control of the controller 70, the depressurizing pump 547 is stopped to be operated, and the atmospheric opening valve 546 is operated to be in an opened state. As a result, as illustrated in FIG. 8A, in the flow-passage pump 54, the negative pressure state of the negative pressure chamber 544B is removed, and the diaphragm 542 is pressed by the coil spring 543. Accordingly, the ink is flown into the inflow chamber 552A, and thus, the pressure of the inflow chamber 552A becomes equal to or more than a predetermined pressure, so that the flexible valve 553 is opened. Therefore, the ink is flown through the third flow-passage 59*c*, the second check valve 55, and the fourth flow-passage 59*d* into the choke valve chamber 562 of the choke valve 56.

In the choke valve 56, a pressing force is exerted to the film 561 due to the inflow of the ink. If the pressing force overcomes a suction force (a force generated by a negative pressure) between the annular convex portion 563 and the film 561, the film 561 is separated from the annular convex portion 563. As a result, due to the function of the negative pressure, the ink together with air bubbles is flown into the print head 33 at one time and discharged from the nozzle 33*a* into the cap 61. Accordingly, in the portions into which the ink is discharged from the nozzle 33*a*, the initial providing by which the portions ranging from the ink cartridge 51 to the nozzle 33*a* are filled with the ink is completed.

After such ink is discharged into the cap 61, by continuing the operation of the suction pump 64 or in the state where the operation of the suction pump 64 is stopped but the remaining negative pressure is exerted, the negative pressure is exerted to the choke valve chamber 562 of the choke valve 56 again, so that the film 561 is pressed to the annular convex portion 563 by large pressure (the choke valve 56 is closed). In addition, by continuing the operation of the suction pump 64, the portions (the fifth flow-passage 59*e*, the pressure adjusting valve 57, the sixth flow-passage 59*f*, and the like) of the downstream side from the discharge hole 564 are in a negative pressure state. In addition, in the portions into which the ink is discharged from the nozzle 33*a*, the discharging of the ink from the nozzle 33*a* does not occur, but the state where the portions between the ink cartridge 51 to the nozzle 33*a* are filled with the ink is sustained. In other words, the initial providing of the one black ink, the cyan ink, and the magenta ink, and the yellow ink is completed.

On the other hand, in the side where the pressing portion 585*c* is pressed into the sealing member 583 by the switching mechanism 58, no negative pressure is exerted to the pressure adjusting valve 57 and the choke valve 56. Therefore, the diaphragm 542 is pressed by the coil spring 543, and only the pressing force is exerted to the third flow-passage 59*c*, the first check valve 53, the fourth flow-passage 59*d*, the choke valve chamber 562 of the choke valve 56 and the pressure adjusting valve 57. In addition, although the ink is flown into the pressure chamber 571B of the pressure adjusting valve 57 in a predetermined pressed state, since the pressing portion 585*c* is pressed into the sealing member 583 as described above, the initial providing of the other black ink is not yet completed.

Second Initial Providing

4. Operations of Switching Mechanism 58

In the aforementioned state, by the control of the controller 70, the switching mechanism 58 is allowed to be operated (second selecting operation), and the plate cam 587 is allowed to rotate by the operation of a motor (not shown). Hereinbefore, in the side (referred to as the other side) where the pressing portion 585*c* is pressed into the sealing member 583, the sealed state is removed, and in the different side (referred to as the one side), the sealing member 583 is pressed by the pressing portion 585*c*.

After that, the suction pump 64 is allowed to be operated (second suction). In addition, in the case where a sufficient negative pressure remains, the suction pump 64 may not be operated. Herein, in the recessed fitting portion 581A for supplying the black ink to the other side in the switching mechanism 58, since the sealing member 583 is separated from the valve seat 581*c*, the negative pressure, which is exerted to the downstream side from the insertion hole 588 and the seventh flow-passage 59*g*, is exerted to the upstream side thereof. On the other hand, as described above, the ink is flown into the upstream side from the sealing member 583 in a predetermined pressed state. Therefore, as described above, if the sealing member 583 is separated from the valve seat 581*c*, the other side of the black ink together with air bubbles is flown into the print head 33 at one time and discharged from the nozzle 33*a* into the cap 61. Accordingly, the initial providing of the other side of the black ink is completed. In other words, the state illustrated in FIG. 9C is obtained.

5. Other Operations

In addition to the aforementioned operations, after the operations of (4), while continuing the operation of the suction pump 64 or in the state where the operation of the suction pump 64 is stopped but the remaining negative pressure is exerted, the flow-passage pump 54 is allowed to be operated, so that the ink may be supplied t the print head 33. Herein, an amount of the ink supplied by the operation is necessarily smaller than the providing ink amount in the first initial providing. In this case, this is because the discharging ink amount at one cycle including the first initial providing and the second initial providing is less than twice the ink amount required for providing the ink to all the flow-passages, so that the discharging ink amount is decreased in comparison with the related art.

In addition, the ink amount supplied by the operation may be used as the ink amount for providing the portions to which large negative pressure is exerted by continuing the operation of the suction pump 64 (or the ink amount for removing the negative pressure of the portions to which large negative pressure is exerted).

More specifically, the ink amount for providing all the flow-passages of the downstream side from the discharge hole 564 of the choke valve 56, to which the negative pressure is exerted, may be used. In addition, by taking into consideration that the change in the volume of the fifth flow-passage 59*e* caused by the exertion of the negative pressure is very small, the ink amount for providing all the flow-passages of the downstream side from the pressure chamber 571B and the pressure chamber 571B of the pressure adjusting valve 57 may be used.

In this case, by continuing the operation of the suction pump 64, the ink may be flown into the portions, to which large negative pressure is exerted, or into the portions, where the operation of the suction pump 64 is stopped but the remaining negative pressure is exerted, so that the negative pressure of the portions, which the large negative pressure is exerted to, may be removed. Therefore, it is possible to prevent the ink discharged into the cap 61 from being suctioned from the nozzle 33*a*.

Effects

According to the printer 10 having the aforementioned configuration, after one cycle of the operation of the flow-passage pump 54, the controller 70 allows the cap 61 to contact with the nozzle formation plane, where the nozzle 33*a* is exposed, and allows the suction pump 64 to be operated. Accordingly, the ink may be provided into the flow-passage 59 from the upstream side to the downstream side in the flow-passages except for the flow-passage 59 which is not selected by the switching mechanism 58. In addition, since the switching mechanism 58 is driven, the ink may be provided into the flow-passage 59 which is not initially selected by the switching mechanism 58. At this time, since the ink amount discharged by the contraction of the pump chamber 544A is controlled to be less than twice the ink amount required for providing the ink into all the portions from the upstream side to the downstream side of the flow-passage 59, it is possible to reduce the ink amount that is uselessly discharged.

In addition, since the initial providing of the ink is performed by using the cap 61 which forms one sealing space, the configuration of the cap 61 is simplified, so that it is possible to reduce the cost. In addition, in the ink supply mechanism 50, the configuration is prevented from being complicated, so that it is possible to reduce the cost.

In addition, a pressure adjusting valve 57 is disposed at the upstream side from the switching mechanism 58 and at the downstream side from the flow-passage pump 54 in the flow-passage 59. The pressure adjusting valve 57 has a pressure chamber 571B into which the ink flown and is configured to be opened in the case where an internal pressure of the pressure chamber 571B is less than a predetermined pressure due to a decrease in the ink amount and to be closed in the other cases.

Therefore, in the case where the print head 33 dose not consume the ink, it is possible to prevent an excessive ink amount from being supplied from the pressure chamber 571B to the print head 33, so that it is possible to optimize the ejection of the ink from the print head 33.

In addition, in the embodiment, if the flow-passage pump 54 is allowed to be operated at one cycle and if the cap 61 is allowed to contact with the nozzle formation plane so as for the suction pump 64 to be operated, it is possible to provide the ink into all the flow-passages 59 except for the flow-passage 59, which is not selected by the switching mechanism 58, among the flow-passages 59 for supplying two types of black ink. At this time, the other flow-passage 59, which is not selected, is in the state where a large negative pressure is exerted to the downstream side from the switching mechanism 58 by the operation of the suction pump 64. In addition, in all the flow-passages 59 except for the flow-passage 59, which is not selected, since the subsequent supply of the ink is not performed by only the one cycle operation of the flow-passage pump 54, the choke valve 56 is in the closed state by the operation of the suction pump 64, so that the supply of the ink is blocked. In the other flow-passage 59, which is not selected, the ink is in the pressed state by the one cycle operation of the flow-passage pump 54. After that, if the switching mechanism 58 is allowed to be operated and the operation of allowing the supply of the ink from the other flow-passage 59, which is not selected, is performed, the negative pressure is exerted to the downstream side from the switching mechanism 58, and the ink is in the pressed state in the other flow-passage 59, which is not selected, so that it is possible to provide the ink into the other flow-passage 59, which is not selected.

In addition, since the ink is not supplied from the flow-passage pump 54 from the upstream side to the downstream side in the flow-passages except for 59, which is not initially selected, and since the choke valve 56 is still in the closed state, it is possible to suppress the ink from being discharged.

Accordingly, unlike the related art, in the case where the initial providing of the two types of ink is performed in the printer 10 having the switching mechanism 58, it is possible to prevent the ink irrelevant to the two types of the ink from being uselessly wasted.

In addition, in the aforementioned embodiment of the invention, after providing the ink into the other flow-passage 59, which is not initially selected (or after performing the second suction of the suction pump 64) or together with the providing (or together with performing the second suction of the suction pump 64), the controller 70 allows the flow-passage pump 54 to be operated so as for a predetermined ink amount to be supplied through flow-passage 59 to the print head 33.

Therefore, due to the operation of the suction pump 64, it is possible to remove the negative pressure exerted to the flow-passage 59 of the downstream side from the choke valve 56. In other words, in the case where the aforementioned negative pressure is not removed, the exertion of the negative pressure may cause a problem in that the ink discharged into the cap 61 may be flown backwards from the nozzle 33*a*. However, after providing the ink into the other flow-passage 59, which is not initially selected (or after performing the second suction of the suction pump 64) or together with the providing (or together with performing the second suction of the suction pump 64), if the flow-passage pump 54 is allowed to be operated so as for a predetermined ink amount to be supplied, the negative pressure may be removed, so that it is possible to prevent the ink from being flown backward from the nozzle 33*a*.

In addition, in the case where the ink is flown into from the nozzle 33*a* due to the backward flow, since the ink in the cap 61 is flown thereto, the mixture of the ink of the colors is flown thereto, so that an image quality of the printing result on the printing medium P deteriorates. However, as described above, the negative pressure is removed by the supply of a predetermined ink amount, so that it is possible to maintain the image quality of the printing result on the printing medium P in a good state.

Modified Example

Hereinbefore, the embodiment of the invention is described. However, various modifications may be available for the invention. Hereinafter, the modifications will be described.

In the aforementioned embodiments, the ink supply mechanism 50 is a flow-passage pump which may control a discharging ink amount. The ink supply mechanism 50 is a flow-passage pump 54, so-called a diaphragm pump, which is configured to have a diaphragm 542 capable of flexing a pump chamber 544A which suctions the ink at the time of expansion in an internal volume due to an externally applied force and discharges the ink at the time of contraction in the internal volume due to an externally applied force. However, besides the diaphragm pump, any pump which is controlled to suction the ink from the ink cartridge 51 and to discharge a predetermined ink amount may be used as the flow-passage pump 54.

For example, a reciprocating movement pump such as a piston pump and a plunger pump and a rotary pump such as a tube pump, a gear pump, a vane pump, and a screw pump may be used. In the case of the reciprocating movement pump, similarly to the diaphragm pump, if the dischargeable ink amount per one cycle (one reciprocating movement) is acquired, the controller may control a predetermined ink amount to be discharged by operating the pump at one cycle or at a plurality of cycles. In addition, in the case of the rotary pump, if the dischargeable ink amount per one rotation is acquired, the controller may control a predetermined ink amount to be discharged by operating the pump at the necessary number of rotations.

In the aforementioned embodiments, the ink supply mechanism 50 includes a first check valve 53, a second check valve 55, and a pressure adjusting valve 57. However, the ink supply mechanism 50 may has a configuration where at least one of the above components is not provided. This is because the ink supply mechanism 50 having the configuration where at least one of the first check valve 53, the second check valve 55, and the pressure adjusting valve 57 is not provided may also achieve the invention.

In addition, in the aforementioned embodiments, the first check valve 53, the second check valve 55, the choke valve 56, and the pressure adjusting valve 57 may also have different configurations. For example, instead of the configuration having a film (diaphragm), these valves may employ various types of valves such as a swing type valve, a wafer chucky type valve, a lift type valve, or a foot valve.

In addition, in the aforementioned embodiments, the ink cartridge 51 is configured to individually store cyan ink, magenta ink, yellow ink, photo black ink, and matt black ink. However, the ink cartridge 51 is not limited to storing such inks, but for example, at least one of light cyan, light magenta, gray, light gray, green, orange, and the like may be stored. In addition, in the aforementioned embodiments, the inks of which the supplying is switched by the switching mechanism 58 are the photo black ink and the matt black ink. However, the inks of which the supplying is switched by the switching mechanism 58 are not limited to the photo black ink and the matt black ink. For example, the gray ink and the light gray ink or the light magenta ink and the vivid light magenta ink are configured to be switched.

In addition, in the aforementioned embodiments, the depressurizing pump 547 is driven; after that, the suction pump 64 is driven; and after that, the atmospheric opening valve 546 is driven. However, before the operation of the depressurizing pump 547, the suction pump 64 may be operated.

In addition, in the aforementioned embodiments, as "(5) Other Operations", by continuing the operations of the suction pump 64 or in the state where the operation of the suction pump 64 is stopped but the remaining negative pressure is exerted, the flow-passage pump 54 is allowed to be operated so as for the ink to be supplied to the print head 33, so that the negative pressure of the portions, which the large negative pressure is exerted to, is removed. Therefore, it is possible to prevent the ink discharged into the cap 61 from being suctioned from the nozzle 33*a*. However, in the case where, although a negative pressure is exerted, the flexing portion is small, so that the volume of the flow-passage is not almost changed, the controller 70 allows the print head 33 to be driven instead of the operation of the suction pump 64, the ink amount which is flown into the nozzle 33*a* due to the negative pressure or an ink amount equal to or more than the ink amount may be ejected. In this case, although the mixture of the ink of the colors is flown into the nozzle 33*a*, the mixed ink is dischargeable from the nozzle 33*a*, it is possible to maintain the image quality of the printing result on the printing medium P in a good state.

In addition, in the aforementioned embodiments, the discharging ink amount per one cycle including the first initial providing and the second initial providing is configured to be less than twice the ink amount required for providing the ink to all the flow-passages. Herein, in the case of performing the aforementioned operations of (1) to (4), although the discharging ink amount is more than one or more times the ink amount required for providing the ink to all the flow-passages, the increased portion is obtained by adding the portion which is flown into the cap 61 due the influence of the negative pressure at the time of operation of the suction pump 64. However, this added portion is a very small amount and is greatly smaller than twice the ink amount required for providing the ink to all the flow-passages.

In addition, in the case of performing the aforementioned operation of (5), by taking into consideration that the portions which the negative pressure is exerted to is the downstream side from the choke valve 56, the discharging ink amount is obtained by adding the ink amount for providing the portions, which large negative pressure is exerted to, by continuing the operation of the suction pump 64 or the ink amount for removing the negative pressure of the portions, which large negative pressure is exerted to, to once the ink amount required for providing the ink to all the flow-passages, so that the discharging ink amount is greatly smaller than twice the ink amount required for providing the ink to all the flow-passages.

The ink amount discharged by the above operation may be the ink amount for providing all the flow-passages of the downstream side from the discharge hole 564 of the choke valve 56, which the negative pressure is exerted. In addition, by taking into consideration that the change in the volume of the fifth flow-passage 59*e* by the exertion of the negative pressure is very small, the ink amount discharged by the above operation may be the ink amount for providing all the flow-passages of the downstream side from the pressure chamber 571B and the pressure chamber 571B of the pressure adjusting valve 57.

In addition, although the ink amount which is flown into the cap 61 due to the influence of the negative pressure by continuing the operation of the suction pump 64 may be added, since the ink amount is very small, the discharging ink amount is greatly smaller than twice the discharging ink amount of the related art.

In addition, in the aforementioned embodiments, the controller 70 may be implemented in a software manner or has a configuration implemented in a circuit manner.

In addition, the printer 10 is not limited to an inkjet type printer 10, but for example, a gel jet type printer may be used. In addition, besides the printer, a multifunctional apparatus including a scanner machine, a facsimile machine, a copying machine, or the like may be employed as a printer according to the invention.

In addition, in a concept of the printer 10 According to the aforementioned embodiments, there may be included a fluid ejecting apparatus which ejects a liquid (including a liquid itself, a liquid state material where particles of a functional material are dispersed or mixed into a liquid, or a material having fluidity such as gel) other than ink. As an example, there are a liquid state material ejecting apparatus for ejecting a liquid which contains dispersed or dissolved materials such as electrode materials or colorant materials (materials for pixels) used for manufacturing a liquid crystal display, an EL (Electroluminescence) display, and a surface emission display or the like, a fluid ejecting apparatus for ejecting bio-organic materials used for manufacturing a bio chip, a fluid ejecting apparatus for ejecting a liquid which is a sample used as a precision pipette, or the like.

In addition, in a concept of the printer 10 According to the invention, there may be included a fluid ejecting apparatus for ejecting a lubricant into a precision machine such as a watch or a camera by using a pinpoint, a fluid ejecting apparatus for ejecting a transparent resin solution such as a UV cured resin on a substrate in order to form semispherical micro-lenses (optical lenses) used for an optical communication device or the like, a fluid ejecting apparatus for ejecting an etchant such as an acidic solution or an alkali solution in order to etch a substrate or the like, a fluid state material ejecting apparatus for ejecting a fluid state material such as gel (for example, physical gel), or the like.

The entire disclosure of Japanese Patent Application No. 2009-222103, filed Sep. 28, 2009 and 2010-156586, filed Jul. 9, 2010 are expressly incorporated by reference herein.

What is claimed is:

1. A liquid ejecting apparatus comprising:

a liquid ejecting head which is configured to have a nozzle group of ejecting one type of liquid and a nozzle group of ejecting two types of liquid, and thereby being capable of ejecting plural types of liquid from a plurality of the nozzle groups;

a cap which is configured to contact with a nozzle formation plane, where the nozzle groups of the liquid ejecting head are exposed, to form one sealing space;

a suction pump which is configured to suction the sealing space;

a plurality of flow-passages which are configured to supply the plural types of liquid from a liquid container toward the liquid ejecting head;

flow-passage pumps, which are located at the downstream side from the liquid container, in the plurality of flow-passages, are capable of suctioning each type of liquid from the liquid container and discharging each type of liquid toward the downstream side;

for each of the flow-passages there exists a choke valve which is configured to have a valve chamber which is located at the downstream side from a corresponding flow-passage pump in the corresponding flow-passage, to allow the liquid to be flown therein, a flexible member configured to change a volume of the valve chamber by flexing, and a discharge hole which exists in an inner portion of the valve chamber and is capable of being opened or closed by the flexing of the flexible member, wherein in a case where a predetermined negative pressure or less is applied to the valve chamber, the flexible member is allowed to close the discharge hole, so that the downstream side thereof is allowed to be in a negative pressure state;

a switching mechanism which is located at the downstream side from two choke valves of two flow-passages and which is connected to only one of the two flow-passages at a time, so that only the liquid from one of the two flow-passages is supplied to the nozzle group of ejecting the two types of liquid, and the liquid from the other of the two flow-passages is blocked from being supplied;

a controller which is configured to control operations of the liquid ejecting head, the suction pump, the switching mechanism, and the flow-passage pumps, wherein the controller allows all the flow-passage pumps to be operated so that a predetermined amount of all the liquids is in a dischargeable state, allows the cap to contact with the nozzle formation plane so that the suction pump is operated, and allows the switching mechanism to be operated so that the predetermined amount, at the time of providing all the liquids into all the flow-passages, is equal to or more than a liquid amount required for providing all the liquids into all the flow-passages and is less than twice the liquid amount required for providing all the liquids into all the flow-passages.

2. The liquid ejecting apparatus according to claim 1, wherein the controller allows all the flow-passage pumps to be operated so that the predetermined amount of all the liquids is in a dischargeable state, allows the cap to contact with the nozzle formation plane so that the suction pump is operated, and allows the switching mechanism to be operated so that the predetermined amount, at the time of providing all the liquids into all the flow-passages, is equal to or more than a liquid amount required for providing all the liquids into all the flow-passages and is equal to or less than a liquid amount obtained by adding a liquid amount required for providing all the liquids into all the flow-passages of the downstream side from the choke valve to the liquid amount required for charging providing all the liquids into all the flow-passages.

3. The liquid ejecting apparatus according to claim 1, wherein the controller allows the switching mechanism to be operated to perform a first selecting operation of allowing supply of one of the two types of liquid from one of the two flow passages that share the switching mechanism, allows all the flow passage pumps to be operated so that a liquid amount, required for providing all the liquids into all the flow-passages, is provided and is in a dischargeable state, allows the cap to contact with the nozzle formation plane so that the suction pump is operated to perform a first suction of all the liquids from the nozzles of the liquid ejecting head, allows the switching mechanism to be operated to perform a second selecting operation of allowing supply of the other of the two types of liquid from the other of the two flow passages that share the switching mechanism, and allows the cap to contact with the nozzle formation plane so that the suction pump is operated a second time to perform a second suction of all the liquids from the nozzles of the liquid ejecting head.

4. The liquid ejecting apparatus according to claim 3, wherein the controller, after the second suction or at the same time of the second suction, allows all the flow-passage pumps to be operated so that a liquid of amount equivalent to a liquid amount required for providing all the liquids into all the flow-passages of the downstream side from all the choke valves, is supplied through the flow-passages toward the liquid ejecting head.

5. The liquid ejecting apparatus according to claim 3, comprising:

at the downstream side from a choke valve, a pressure chamber which a liquid is flown into, a flexible member which is configured to change a volume of the pressure chamber by flexing in response to a change in an internal pressure of the pressure chamber, and a pressure adjusting valve which is configured to be opened in the a case where the internal pressure of the pressure chamber is less than a predetermined pressure by the flexing of the flexible member and to be closed in the other cases, wherein one of the flow passages corresponds to the pressure adjusting valve;

wherein the controller, after the second suction or at the same time of the second suction, allows all the flow-passage pumps to be operated so that an amount of a type of liquid, equivalent to an amount required for providing the type of liquid into the pressure adjusting valve and the corresponding flow-passage of the downstream side from the pressure adjusting valve, is supplied through the corresponding flow-passage toward the liquid ejecting head.

6. A liquid providing method of performing initial providing of a liquid in a liquid ejecting apparatus, wherein the liquid ejecting apparatus includes:

a liquid ejecting head which is configured to have a nozzle group of ejecting one type of liquid and a nozzle group of ejecting two types of liquid, and thereby being capable of ejecting plural types of liquid from a plurality of the nozzle groups;

a cap which is configured to contact with a nozzle formation plane, where the nozzle groups of the liquid ejecting head are exposed, to form one sealing space;

a suction pump which is configured to suction the sealing space;

a plurality of flow-passages which are configured to supply the plural types of liquid from a liquid container toward the liquid ejecting head;

flow-passage pumps, which are located at the downstream side from the liquid container, in the plurality of flow-passages, are capable of suctioning each type of liquid from the liquid container and discharging each type of liquid toward the downstream side;

for each of the flow-passages there exists a choke valve which is configured to have a valve chamber located at the downstream side from a corresponding flow-passage pump in the corresponding flow-passage, to allow the liquid to be flown therein, a flexible member configured to change a volume of the valve chamber by flexing, and a discharge hole which exists in an inner portion of the valve chamber and is capable of being opened or closed by the flexing of the flexible member, wherein in a case where a predetermined negative pressure or less is applied to the valve chamber, the flexible member is allowed to close the discharge hole, so that the downstream side thereof is allowed to be in a negative pressure state;

a switching mechanism which is located at the downstream side from two choke valves of two flow-passages and which is connected to only one of the two flow-passages at a time, so that only the liquid from one of the two flow-passages is supplied to the nozzle group of ejecting the two types of liquid, and the liquid from the other of the two flow-passages is blocked from being supplied;

a controller which is configured to control operations of the liquid ejecting head, the suction pump, the switching mechanism, and the flow-passage pumps, the liquid providing method comprising:

allowing the switching mechanism to be operated to perform a first selecting operation of allowing supply of one of the two types of liquid from one of the two flow passages that share the switching mechanism;

allowing all the flow-passage pumps to be operated so that a liquid amount required for providing all the liquids into all the flow-passages is in a dischargeable state;

allowing the cap to contact with the nozzle formation plane so that the suction pump is operated to perform a first suction of all the liquids from the nozzles of the liquid ejecting head;

allowing the switching mechanism to be operated to perform a second selecting operation of allowing supply of the other of the two types of liquid from the other of the two flow passages that share the switching mechanism; and allowing the cap to contact with the nozzle formation plane so that the suction pump is operated a second time to perform a second suction of all the liquids from the nozzles of the liquid ejecting head, wherein after the second suction or at the same time of the second suction, allowing all the flow-passage pumps to be operated so that a liquid amount equivalent to a liquid amount required for providing all the liquids into all the flow-passages of the downstream side from all the choke valves, is supplied through the flow-passages toward the liquid ejecting head.

7. The liquid providing method according to claim 6, wherein the liquid ejecting head includes: at the downstream side from a choke valve, a pressure chamber which a liquid is flown into, a flexible member which is configured to change a volume of the pressure chamber by flexing in response to a change in an internal pressure of the pressure chamber, and a pressure adjusting valve which is configured to be opened in a case where the internal pressure of the pressure chamber is less than a predetermined pressure by the flexing of the flexible member and to be closed in the other cases, wherein one of the flow passages corresponds to the pressure adjusting valve, and wherein the liquid providing method comprises: after the second suction or at the same time of the second suction, allowing all the flow-passage pumps to be operated so that an amount of a type of liquid, equivalent to an amount required for providing the type of liquid into the pressure adjusting valve and the corresponding flow-passage of the downstream side from the pressure adjusting valve, is supplied through the corresponding flow-passage toward the liquid ejecting head.

8. A liquid providing method of performing initial providing of a liquid in a liquid ejecting apparatus, wherein the liquid ejecting apparatus includes:

a liquid ejecting head which is configured to have a nozzle group of ejecting one type of liquid and a nozzle group of ejecting two types of liquid, and thereby being capable of ejecting plural types of liquid from a plurality of the nozzle groups;

a cap which is configured to contact with a nozzle formation plane, where the nozzle groups of the liquid ejecting head are exposed, to form one sealing space;

a suction pump which is configured to suction the sealing space;

a plurality of flow-passages which are configured to supply the plural types of liquid from a liquid container toward the liquid ejecting head;

flow-passage pumps, which are located at the downstream side from the liquid container, in the plurality of flow-passages, are capable of suctioning each type of liquid from the liquid container and discharging each type of liquid toward the downstream side;

for each of the flow-passages there exists a choke valve which is configured to have a valve chamber located at the downstream side from a corresponding flow-passage pump in the corresponding flow-passage, to allow the liquid to be flown therein, a flexible member configured to change a volume of the valve chamber by flexing, and a discharge hole which exists in an inner portion of the valve chamber and is capable of being opened or closed by the flexing of the flexible member, wherein in a case where a predetermined negative pressure or less is applied to the valve chamber, the flexible member is allowed to close the discharge hole, so that the downstream side thereof is allowed to be in a negative pressure state;

a switching mechanism which is located at the downstream side from two choke valves of two flow-passages and which is connected to only one of the two flow-passages at a time, so that only the liquid from one of the two flow-passages is supplied to the nozzle group of ejecting the two types of liquid, and the liquid from the other of the two flow-passages is blocked from being supplied;

a controller which is configured to control operations of the liquid ejecting head, the suction pump, the switching mechanism, and the flow-passage pumps, the liquid providing method comprising:

allowing the switching mechanism to be operated to perform a first selecting operation of allowing supply of one of the two types of liquid from one of the two flow passages that share the switching mechanism;

allowing all the flow-passage pumps to be operated so that a liquid amount required for providing all the liquids into all the flow-passages is in a dischargeable state;

allowing the cap to contact with the nozzle formation plane so that the suction pump is operated to perform a first suction of all the liquids from the nozzles of the liquid ejecting head;

allowing the switching mechanism to be operated to perform a second selecting operation of allowing supply of the other of the two types of liquid from the other of the two flow passages that share the switching mechanism; and allowing the cap to contact with the nozzle formation plane so that the suction pump is operated a second time to perform a second suction of all the liquids from the nozzles of the liquid ejecting head, wherein the liquid ejecting head includes: at the downstream side from a choke valve, a pressure chamber which a liquid is flown into, a flexible member which is configured to change a volume of the pressure chamber by flexing in response to a change in an internal pressure of the pressure chamber, and a pressure adjusting valve which is configured to be opened in a case where the internal pressure of the pressure chamber is less than a predetermined pressure by the flexing of the flexible member and to be closed in the other cases, wherein one of the flow passages corresponds to the pressure adjusting valve, and wherein the liquid providing method comprises: after the second suction or at the same time of the second suction, allowing all the flow-passage pumps to be operated so that an amount of a type of liquid, equivalent to an amount required for providing the type of liquid into the pressure adjusting valve and the corresponding flow-passage of the downstream side from the pressure adjusting valve, is supplied through the corresponding flow-passage toward the liquid ejecting head.

* * * * *